United States Patent [19]

Zarour

[11] 4,042,245

[45] Aug. 16, 1977

[54] GAME BOARD WITH CODED DICE AND GAME PIECES

[76] Inventor: Louis Yacoub Zarour, 3848 Boren St., San Diego, Calif. 92115

[21] Appl. No.: 621,010

[22] Filed: Oct. 9, 1975

[51] Int. Cl.[2] ..... A63F 3/00

[52] U.S. Cl. ..... 273/134 CH; 273/34 AG

[58] Field of Search ..... 273/134

[56] References Cited

U.S. PATENT DOCUMENTS

| | | | |
|---|---|---|---|
| 1,797,742 | 3/1931 | Ward | 273/134 AG |
| 2,810,578 | 10/1957 | Pacitti | 273/134 CH |
| 2,823,919 | 2/1958 | Scruggs | 273/134 CB |
| 2,933,316 | 4/1960 | Mancini | 273/134 CH UX |
| 3,463,496 | 8/1969 | Weinstein et al. | 273/134 CH |
| 3,951,412 | 4/1976 | Adams | 273/134 CH |

FOREIGN PATENT DOCUMENTS

| | | | |
|---|---|---|---|
| 373,807 | 3/1907 | France | 273/134 CH |

*Primary Examiner*—Delbert B. Lowe
*Attorney, Agent, or Firm*—Brown & Martin

[57] ABSTRACT

A game in which playing pieces are advanced incrementally along a track. The track is divided into individual segmented lanes. Alternating segments of each lane are color coded to correspond to the color of game controlling dice. The uncolored segments are identified by numerals. A raised rib separates the game board into the track area and a central zone. Dice are rolled in the central zone. Each playing piece is moved a number of segments corresponding to the number exhibited on the upward face of the corresponding color coded die.

7 Claims, 2 Drawing Figures

GAME BOARD WITH CODED DICE AND GAME PIECES

BACKGROUND OF THE INVENTION

Games of chance have become quite popular. The surfeit of game shows on television attest to the popularity of games that are characterized by unpredictable outcomes. Other games, such as Keno, are currently quite popular in gambling casinos. In that game, numbers are chosen bingo style from a hopper. Television variations of that game are based on moving number coded games pieces, such a horses, as related number pieces are withdrawn from a hopper. A primary deficiency of such games is that one or more players can endure the entire game without their horses ever moving forward. At a very early stage of the game, the player can lose interest as his horse has no chance of winning.

Therefore, there has been a need for a game of chance in which all of the players can experience movement and hence excitement. The game should produce one winner only, but each player should feel that he has a chance to win at all times.

SUMMARY OF THE INVENTION

In an exemplary embodiment of the invention, the game apparatus comprises a game board. The game board is divided into an outer peripheral area defining individual, uniquely identified lanes. Each lane accommodates a playing piece assigned to one of the players. The playing piece may be in the form of a horse or other racing animal or vehicle. The lanes run parallel to each other and form an oval track having a start and a finish. The lanes are divided into individual segments, each segment representing one move for each playing piece. The object of the game is to move a playing piece from the start to the finish before any other piece traverses the entire track.

A raised rib separates the area occupied by the lanes from the central zone of the game board. The central zone of the game board is designed to accommodate game control means. The game control means are preferably in the form of dice. There are an equal number of dice and lanes of the track. During each turn, the dice are thrown into the central zone of the game board and each playing piece is moved that number of segments corresponding to the number displayed on the upwardly facing horizontal face of the assigned die. The rib permits the dice to be thrown without interferring with the playing pieces.

The individual dice, the individual lanes, and the individual pieces are marked with identifying indicia. In the exemplary embodiment, the indicia constitutes color coding for the lanes, pieces, and dice. For instance, a red die corresponds to a red color coded lane and a red color coded game piece. Similarly, a green die corresponds to a green color coded lane and a green color coded game piece. Therefore a player assigned a playing piece on the green color coded lane moves this playing piece that number of segments as signalled by the green die. In each individual lane, alternating segments of that lane are color coded.

The interposed segments of the color coded lanes are essentially blank except for numerals representing the segment number thereof as measured from the starting place. Therefore, the numerical difference between numbers exhibited on successive interposed segments of an individual lane is two. Furthermore, adjacent segments in juxtaposed individual lanes are not color coded. For instance, if the first lane is color coded in green, then the first segment thereof would be adjacent a numerically designated uncolored segment of the second lane. That segment, in turn, would be adjacent a color coded or red segment of the third lane. The net effect is to produce a checkerboard-like pattern wherein, in the lateral direction, the color coded segments are separated by uncolored numerical segments. In the longitudinal direction, or in direction of the advancement of the playing pieces, all the color coded segments in an individual lane are of the same color. It should also be noted that, in the longitudinal direction, in the first lane the numerical values of the interposed segments are even numbers. In the next adjacent lane, the numbers displayed are odd numbers. The result of the arrangement disclosed is that numerals do not appear on colored segments but are viewed against a white background. The distance from the start is easily determined by looking at the numeral in the adjacent white segment when the game piece lands on a colored segment, and noting the segment number if the piece is on a white segment.

It is therefore an object of the invention to provide a new and improved game.

It is another object of the invention to provide a new and improved game characterized by chance and excitement.

It is another object of the invention to provide a new and improved game that can accommodate from two to many players.

It is another object of the invention to provide a new and improved game in which all of the participants experience some degree of movement during the progress of the game.

It is another object of the invention to provide a new and improved game in which game controlling dice are color coded to correspond to color coding of the game board.

It is another object of the invention to provide a new and improved game that isolates the track from that zone of the game board reserved for the throwing of the dice.

It is another object of the invention to provide a new and improved game in which the progress of the game depends entirely on chance and luck.

It is another object of the invention to provide a new and improved game that includes an over-run portion functioning as a run-off area in the event two playing pieces simultaneously reach the finish.

It is another object of the invention to provide a new and improved game that is simple, inexpensive and exciting.

Other objects and many advantages of this invention will become more apparent upon a reading of the following detailed description and an examination of the drawings, in which like reference numerals designate like parts throughout and in which.

Figure 1:
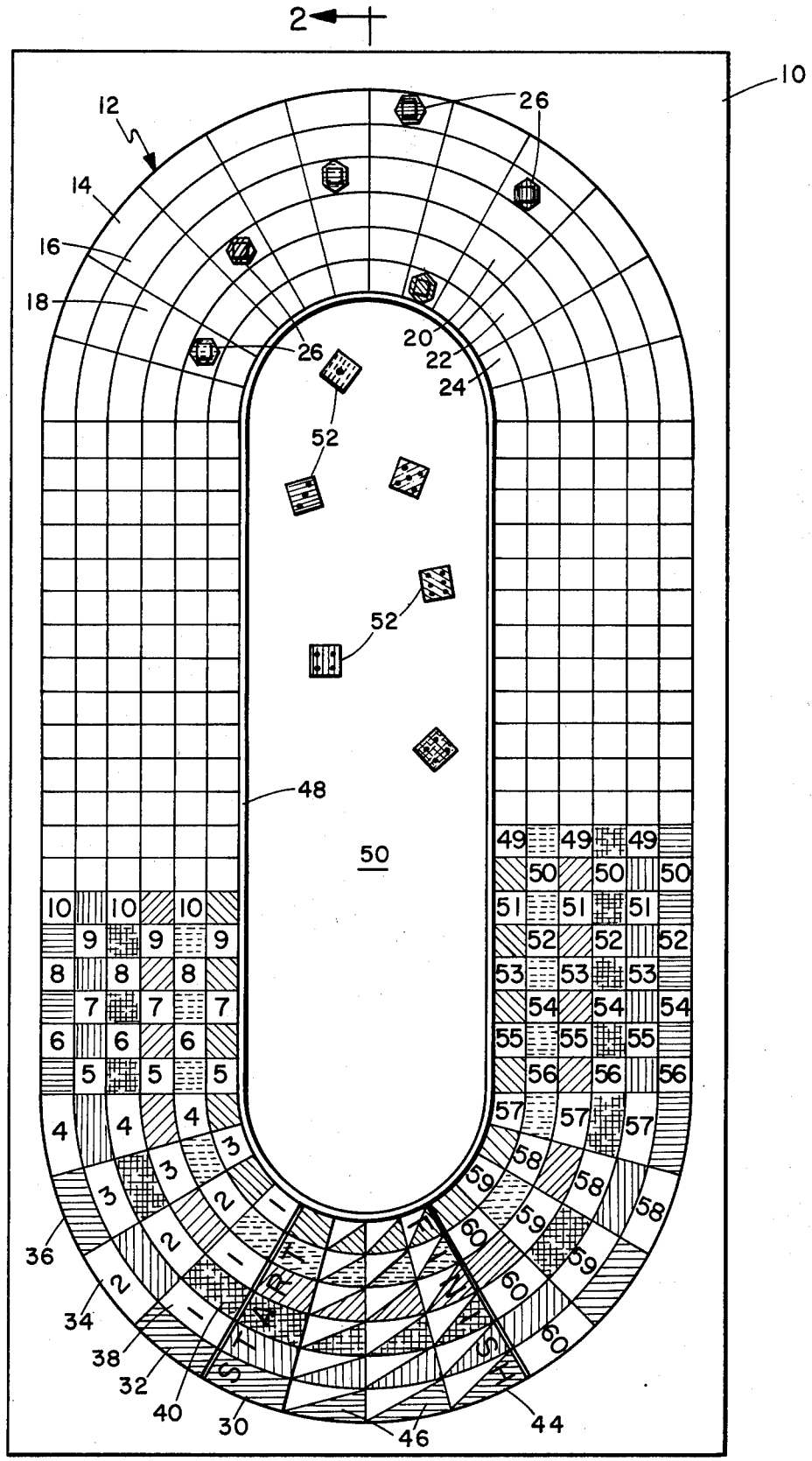
FIG. 1 is a top plan view of the game board.
Figure 2:
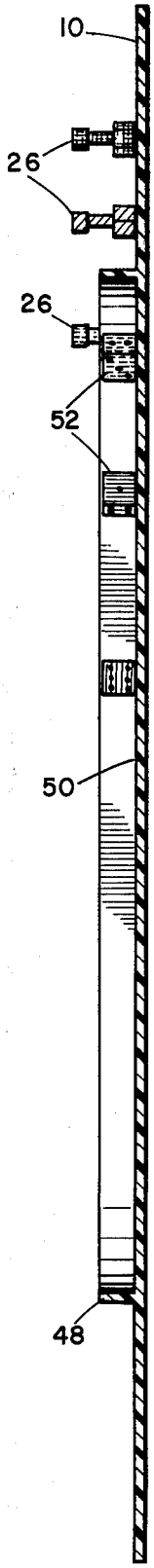
FIG. 2 is a sectional view taken on line 2—2 of FIG. 1.

In the preferred embodiment of the invention, a game board 10 is provided in a rectangular configuraion. The game board is large enough to accommodate a generally oval track 12. The track 12 is divided into individual, uniquely identified lanes 14, 16, 18, 20, 22 and 24. While only six lanes have been illustrated, it will be apparent that any number of lanes from two to about 30 may be provided. The only restriction on the number of lanes is the physical limitations of the game board.

Each individual lane is divided into an equal number of segments of approximately equal length and each representing a single step in the progression of the game. In the playing of the game, each participant is assigned an individual lane. A playing piece 26 is asigned to each participant. The playing piece may be any object so long as it is conveniently accommodated in the individual segments. For instance, pieces representing horses, dogs and automobiles are contemplated. The pieces should be coded to match the coding of the lanes and dice as described hereafter. Each piece is positioned in its assigned lane at the start 30. The start 30, as shown in the preferred embodiment, is merely a segment from which all the lanes emanate. It is to be understood that the start 30 may be represented by any marker on the game board such as a raised surface on which the playing pieces 26 may be supported.

The individual lanes 14 through 24 each comprise the same number of segments. Moreover, each lane is uniquely by certain indicia. In the preferred embodiment, the identifying indicia may include a special design, name or any other means of uniquely identifying each individual lane. In the track illustrated, lane 14 is assigned the color green, lane 16 is assigned the color red and so on, so long as no two colors are repeated. Only the alternating segments of each lane are color coded. For instance, in lane 14, segment 32 is color coded, segment 34 is not color coded, segment 36 is color coded and so on. Segment 34 displays the numeral 2. All the other interposed uncolored segments have numerals thereon which show how far that segment is distal from the start 30. Since only interposed segments display numerals, the numerial difference between any two successive numbers in an individual lane is two.

To provide the track 12 with the appearance of a multi-colored, simulated checkerboard, the color coding in the transverse direction also alternates. Specifically, segment 32 of lane 24 is color coded whereas segment 38 of lane 16 is not color coded and displays the numeral 1. The next segment 40 of lane 18 is color coded and so on. This means that in the transverse direction, no two adjacent segments are either color coded or display numerals. Whereas the numeral displaying interposed segments in lane 14 display even numbers, the numerals displayed by the interposed segments of lane 16 are odd numbers. This offsetting pattern has the effect of producing a simulated and multicolored checkerbroad pattern. In the transverse direction when going from lane 14 toward lane 24, all the numerals exhibited are identical. The foregoing configuraion enables all the participants to assess their relative position on the game board at a glance.

As previously stated, the object of the game is for a playing piece to reach the finish 44 prior to any of the other pieces finishing. The finish may merely be a segment similar to the start 30 or may be any other suitable designation. In the event that two or more playing pieces reach the finish 44 during the same turn, the game is provided with a manner of selecting an individual winner by means of a run-off. Accordingly, a series of over-run segments 46 are provided in each lane. The over-run segments 46 may be individually marked by means of a colored division corresponding to the color coding of the individual lanes. Furthermore, there may be other identifying indicia such as letters displayed by the over-run segments 46. In the event two or more playing pieces 26 cross the finish 44 during the same turn, the playing pieces involved progress along their individual lanes in the over-run segments 46 until one obtains a lead over its competitor.

The game board 10 comprises a raised rib 48 that is generally concentric with respect to the innermost lane 24. The raised rib 48 is oval and defines a generally central zone 50 of the game board 10. The central zone 50 is designed to accommodate the game controlling means. The game controlling means, in the preferred embodiment, comprise dice 52. The raised rib 48 prevents the dice 52 from interfering with the playing pieces 26. There is one die for each lane, and each die is color coded to match the colors of the individual lanes and pieces. The dice 52 are conventional, having six faces, each displaying a different number between one and six. Furthermore, the dice 52, instead of being color coded, may be marked with whatever distinctive indicia that corresponds to that selected to identify the individual lanes and pieces. The invention contemplates the use of alternative game control means such as a rotatable multi-pointed star, which when it comes to rest has each point of the star pointing to a different number on a wheel.

In playing the game, all the dice 52 are gathered and are tossed into the central zone 50 of the game board 10. The upwardly facing horizontal face of each die 52 displays a number between one and six. Each participant then moves his color coded playing piece 26 in his individual lane only, corresponding to the number displayed by his color coded die 52. It is to be noted that the maximum number of segments a playing piece 26 can be moved for a given turn is six. Play continues until one or more playing pieces 26 reach the finish 44. As previously described, in the event of a run-off, play continues in the over-run segments 46 until one playing piece 26 emerges as a winner.

The game that has been previously described maintains excitement from the start 30 to the finish 44. While there will be only one winner, all the playing pieces 26 experience some movement during the course of play, and the suspense of the game does not wane until the emergence of a winner.

Having described my invention, I now claim:

1. Game apparatus for use with incrementally movable playing pieces, the game involving the advancement of the playing pieces in a field of play which comprises:

a game board defining a field of play for use with at least two playing pieces, the field of play comprising a track having a plurality of uniquely identified lanes, one for each playing piece, each lane being divided into individual segments, alternating segments of each land being identified by a selected one of identical visual indicia and the other segments being identified by numerals, the numerical difference between successive numerals in a lane being two, a playing piece being assigned to an individual lane and each playing piece confined to incremental movements from segment to segment within the assigned lane only, and game control means for determining the number of increments the playing pieces are to progress along the assigned lanes, the playing pieces being moved that number of segments corresponding to each signal of the game control means and play continuing until at least one of the playing pieces traverses its entire lane.

2. The game apparatus of claim 1 wherein:

the game board comprises a raised rib separating said track and a center zone of the game board, said rib being adapted for confining the game control means.

3. The game apparatus of claim 1 wherein:

said track includes an over-run portion to accommodate a run-off between playing pieces that concurrently reach the finish.

4. The game apparatus of claim 1 wherein:

the indicia comprise color coding, each lane having a different color code.

5. The game apparatus of claim 1 wherein:

said game control means comprises an individual signaller for each lane that randomly selects the number of segments a playing piece is to moved.

6. The game apparatus of claim 5 wherein:

said individual signaller comprises a die having a plurality of faces, each face identifying a number of segments a playing piece is to advance for a given throw of said die, and each die is marked with indicia corresponding to the indicia for each lane, and the playing piece associated with a given lane advances according to the number of segments signalled by the upwardly facing horizontal face of the associated die.

7. Game apparatus for use with incrementally movable playing pieces, the game involving the advancement of the playing pieces in a field of play which comprises:

a game board defining a field of play for use with at least two playing pieces, the field of play comprising a track having a plurality of uniquely identified lanes, one for each playing piece, each lane being divided into individual segments, alternating segments of each lane being identified by visual indicia, including color coding and numerals, each lane having a different color code, and the difference between successive numerals in a lane being two, and wherein the indicia on adjacent segments of adjacent lanes are alternately code color and numerals so that no indicia on successive transverse adjacent segments are the same, a playing piece being assigned to an individual lane and each playing piece confined to incremental movements from segment to segment within the assigned lane only, and game control means for determining the number of increments the playing pieces are to progress along the assigned lanes, the playing pieces being moved that number of segments corresponding to each signal of the game control means and play continuing until at least one of the playing pieces traverses its entire lane.

* * * * *